United States Patent [19]

Coté

[11] 4,108,450

[45] Aug. 22, 1978

[54] ROLLER SKATE

[76] Inventor: Bernard Coté, 12,270 St. Evariste St., Montreal, Canada

[21] Appl. No.: 791,008

[22] Filed: Apr. 26, 1977

[30] Foreign Application Priority Data

Apr. 28, 1976 [GB] United Kingdom ..... 17226/76

[51] Int. Cl.[2] ..... A63C 17/18

[52] U.S. Cl. ..... 280/7.13; 280/11.22

[58] Field of Search ..... 280/7.12, 7.13, 7.14, 280/11.22, 11.23, 11.19, 11.26, 11.16

[56] References Cited

U.S. PATENT DOCUMENTS

| | | | |
|---|---|---|---|
| 97,075 | 11/1969 | Gibson | 280/11.22 X |
| 1,475,224 | 11/1923 | Orlow | 280/11.16 |
| 1,527,840 | 2/1925 | Chomin | 280/11.22 X |
| 1,530,211 | 3/1925 | Siemnash | 280/7.13 |
| 1,900,040 | 3/1933 | Brien | 280/7.13 |
| 2,190,316 | 2/1940 | Harris | 280/11.26 |
| 3,287,023 | 11/1966 | Ware | 280/11.22 X |

*Primary Examiner*—Joseph F. Peters, Jr.
*Assistant Examiner*—Gene A. Church

[57] ABSTRACT

A roller skate comprising an elongated bar, three rollers carried by said bar in alignment at the bottom of a shoe, the rear and middle rollers being spaced apart a greater distance than the distance between the middle and front rollers and being located on each side of the vertical line passing through the center of gravity of the user. The ground contact zone of the front roller is at a higher level than that of the rear and middle rollers. The bar is detachably secured to separate shoe supporting structures and, therefore, can be replaced by an ice-skate blade. The same shoe supporting structures can be used in association with blades and roller carrying bars of different lengths to fit shoes of different sizes. The rollers have detachable rims of different types for use on different surfaces. In a modified embodiment, the ice-skate blade is spring-loaded at its rear end for use on a rough ice surface, such as on frozen lakes.

5 Claims, 11 Drawing Figures

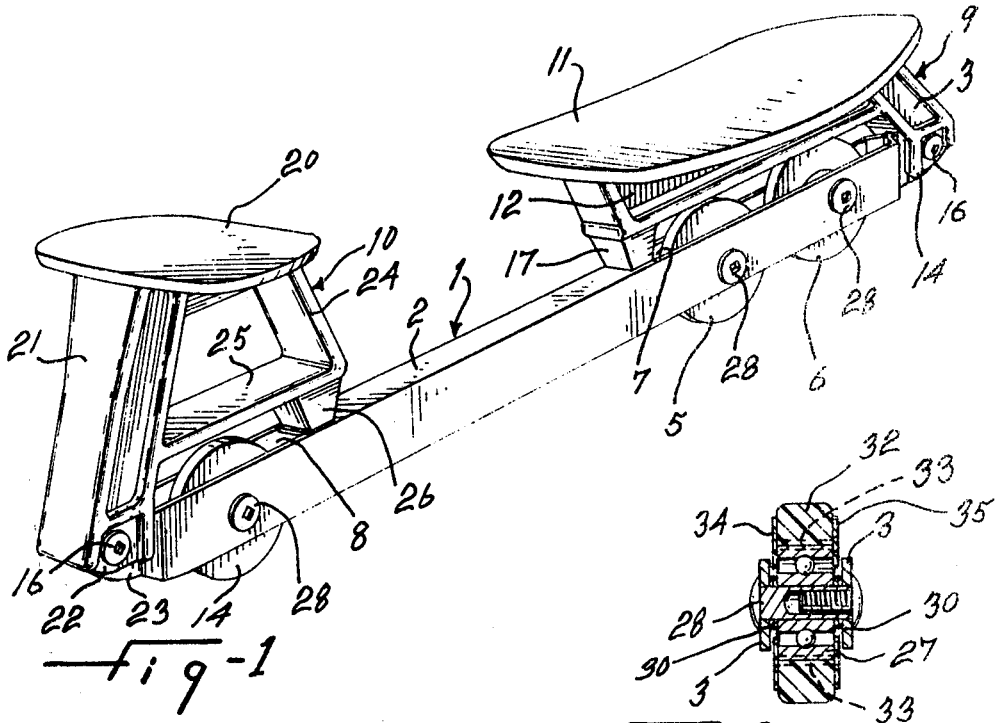
Fig-1
Fig-8
Fig-2
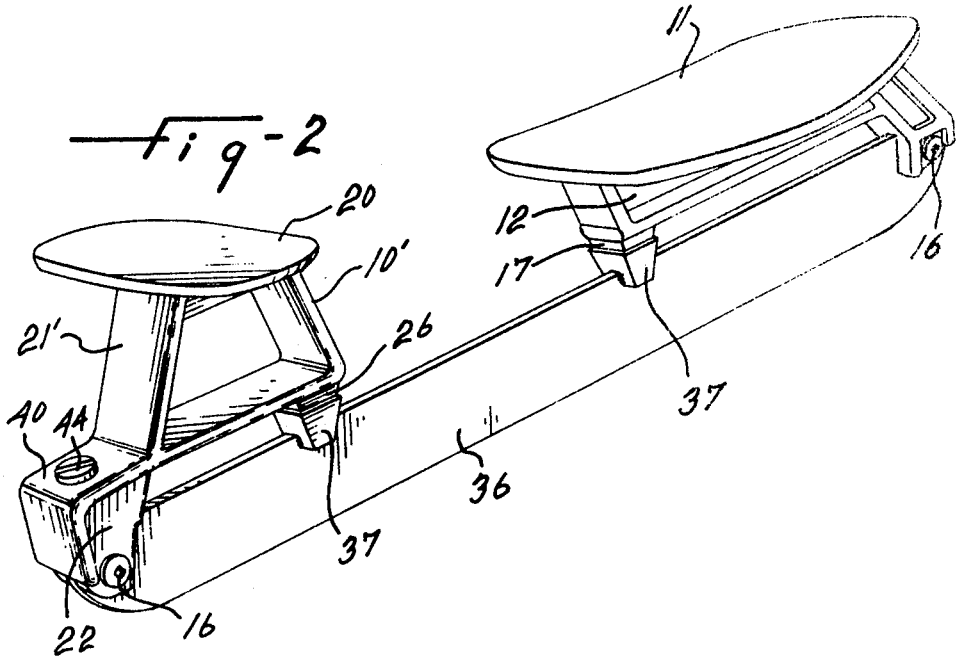

ROLLER SKATE

The present invention relates to a roller skate of the type including a plurality of rollers arranged in a single line longitudinally of the shoe.

The main object of the invention is to provide a roller skate of the character described, which is light in weight, and which enables much greater maneuverability than conventional four-wheel roller skates especially when backing up and when making a turn, its maneuverability being similar to that of ice-skates.

Another object of the invention resides in the provision of a roller skate of the character described, in which two separate shoe supporting structures are each detachably secured to the bar carrying the rollers, so that bar of different lengths can be attached to the same structures to fit shoes of different sizes.

Another object of the invention resides in the provision of a roller skate of the character described, which is easily convertible to an ice-skate, and vice-versa.

Another object of the invention is the provision of a roller skate of the character described, in which the rollers have detachable rims whereby rims of different types can be fitted to the same roller hubs for use on different types of surfaces.

Another object of the invention resides in the provision of a skate of the character described, which is spring-loaded at the back to negotiate a rough surface, especially when an ice-skate blade is used.

The foregoing and other objects of the invention will become more apparent during the following disclosure and by referring to the drawings, in which:

FIG. 1 is a perspective view of the roller skate of the invention;

FIG. 2 is a perspective view of a modified skate converted to an ice-skate;

Figures 3, 4, 5, 6:
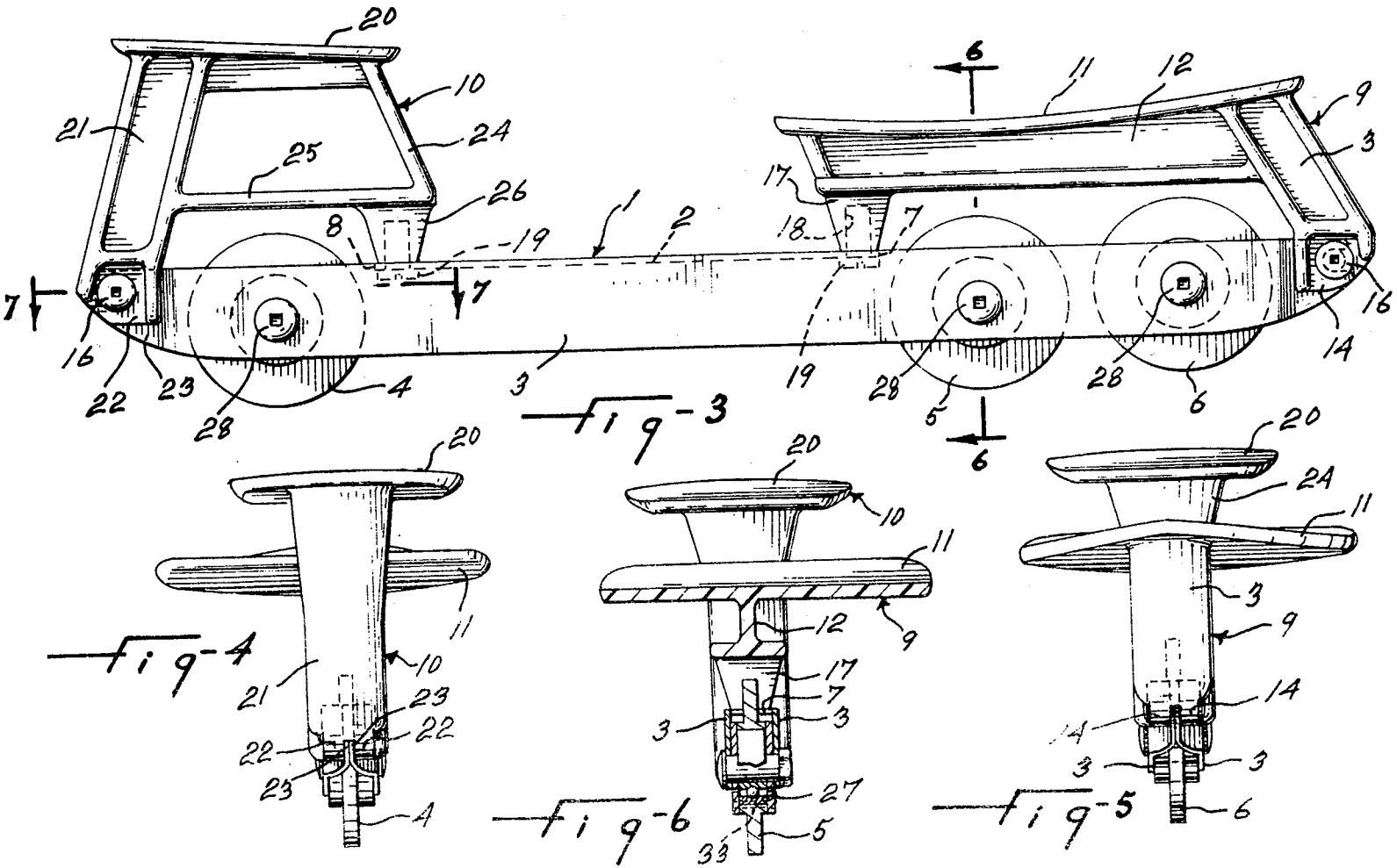
FIG. 3 is a side elevation of the roller skate of FIG. 1.
FIG. 4 is a rear end view of the roller skate of FIG. 3.
FIG. 5 is a front end view of the roller skate of FIG. 3.
FIG. 6 is a cross-section, taken along line 6—6 of FIG. 3.
Figures 7, 9, 10, 11:
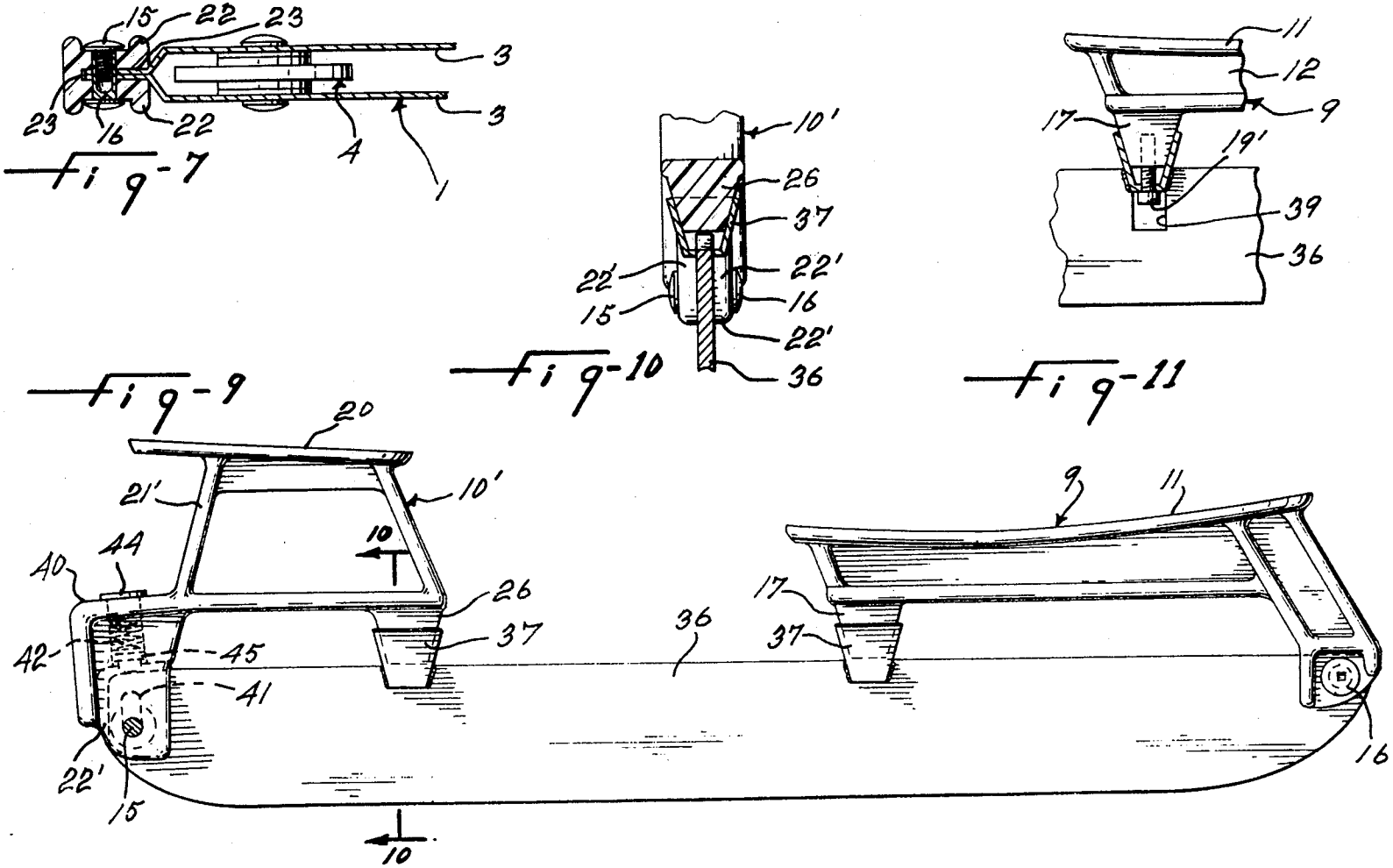
FIG. 7 is a plan section, taken along line 7—7 of FIG. 3.

FIG. 8 seen on the first page of the drawings, is a cross-section a roller fitted with a plastic rim;

FIG. 9 seen on the last page of the drawings, is a side elevation of the modified embodiment of FIG. 2 used as an ice-skate;

FIG. 10 is a cross-section taken along line 10—10 of FIG. 9; and

FIG. 11 is a partial elevation, partially in vertical section, of a modified arrangement for securing the ice-skate blade to the shoe sole supporting structures.

In the drawings, like reference characters indicate like elements throughout.

The roller skate, seen in FIGS. 1, 3, 4, 5, 6, and 7, comprises an elongated roller carrying bar 1, preferably made of sheet metal and having a U-shape cross-section, including a top web 2 and parallel side flanges 3 opening at the bottom of the bar.

The bar carries three rollers in longitudinal alignment, namely: a rear roller 4, a middle roller 5 and a front roller 6.

Rear roller 4 is disposed near the rear end of the bar 1, while the middle and front rollers are close together at the front end portion of the bar 1. The distance between the middle and front rollers is much smaller than the distance between the middle and rear rollers. Furthermore, the ground contact area of the front roller is higher than the ground contact areas of the middle and rear rollers, such that, when the two latter rollers bear on a supporting surface, the front roller does not touch this surface, when the skate is upright. The front roller will come in contact with the surface when the skate is laterally tilted to one or the other side.

The rollers extend upwardly from the web 2 through openings 7 and 8, made in said web.

Separate front and back shoe supporting frames 9 and 10 are removably secured to the bar 1. The front frame 9 includes a shoe sole plate 11 adapted to be fixed to the front portion of a shoe sole. The sole plate 11 is reinforced by a longitudinal integral member 12, on the front end of which downwardly extends a leg 13, which forms two spaced ears 14 at its lower end, said ears adapted to straddle the two side flanges 3 of bar 1 at the front end of the bar, said flanges being, at the front end, bent and brought together in contact, as clearly shown in FIG. 4. The ears 14 and the front portions of the flanges 3 are provided with registering holes for the removable insertion of a securing bolt 15 and nut 16, as shown in FIG. 7. The sole plate 11 and reinforcement 12 extend rearwardly from the front leg 13 over the front and middle rollers 6 and 5 is supported at the back by a downwardly extending tapering stud 17 resting on the top web 2 of the bar 1. Stud 17 has a threaded bore 18 for receiving a bolt 19 passing through a hole made in the web 2.

The back shoe-supporting frame 10 is similar in construction and in its manner of being secured to the bar 1, except that it is shorter than the front frame 9 and with its sole plate 20 disposed at a higher level than sole plate 11.

Sole plate 20 is integral with a downwardly extending rear leg 21, itself provided at its lower end with a pair of parallel ears 22 straddling the bent and contacting rear portions 23 of the flanges 3 of bar 1, said flange portions 23 being provided with holes in register with the holes in ears 22 for the removable connection of the bar to the back leg 21 by means of a bolt 15 and nut 16.

The frame 10 has a downwardly extending front leg 24 connected with a transverse frame member 25 overlying the rear roller 4. A stud 26, similar to stud 17, downwardly secured to the web 2 of bar 1 by means of a bolt 19 screwed within a bore of the stud and passing through the web 2.

The front and back shoe supporting frames 9 and 10 can each be made of synthetic resin as a one-piece part in a molding operation. Obviously, since the two frames are separate from each other and each is independently removably attached to the bar 1, it is obvious that bars 1, of different lengths, can be fitted with the same shoe frames 9 and 10, in order to fit shoes of different sizes.

Each roller 4, 5, 6 is removably mounted between the flanges 3 of bar 1, being supported on a bolt and nut assembly 28. Each roller includes a hub consisting of a ball bearing 29, the inner race of which fits over the bolt 28 and is squeezed between the flanges 3 by means of washers 30. The outer race 27 of the ball bearing 29 has transverse notches equally spaced around its periphery, adapted to register with similar notches formed at the inner cylindrical surface of a roller rim such as the metal of FIG. 6, or the plastic rim 32 of FIG. 8. Either metal rim 31 or the plastic rim 32 can be secured to the outer race 27 of the same ball bearing 29 by means of bolts 33 extending through the above-noted notches, or grooves, and screwed at one end within an annular retaining washer 34 and the head of which engages the opposite annular retaining washer 35.

Washers 34 and 35 extend down close to the inner race of the ball bearing and acts also as dust protectors for the ball bearing. When the roller skate is used on a smooth concrete surface, the plastic rims 32 are fitted to the roller hubs, while, when the roller skate is used on a plastic surface, the metal rims 31 will replace the plastic rollers. Metal rims 31 are narrow and have a peripheral face which is straight in cross-section defining sharp circumferential edges to prevent lateral slipping on a plastic surface.

The whole assembly of the bar 1 with its rollers can be quickly removed and replaced by an ice-skate blade, whereby the roller skate is easily convertible to an ice-skate. For this purpose, the ice-skate 36, shown in FIG. 2, has the same thickness as the combined thickness of the two flanges 3 of the web 2 and, therefore, their front and back end can have a snug fit between the front and back ears 14 and 22 of the frames 9 and 10, respectively. The blade 36 has front and back holes registering with the holes of ears 14 and 22 for the removable connection of the blade to the ears by means of the same bolts 15 and nuts 16, as in FIG. 1. Furthermore, the blade 36 has upwardly flaring cup members 37, welded otherwise secured to the top edge portion of the blade and adapted to snugly receive the downwardly tapered studs 17 and 26 of the front and back shoe supporting frames and will not tilt with respect to the same. To more firmly secure the blade 36 to the studs 17 and 26, the system shown in FIG. 11 can be used. The top portion of the blade 36′ has a notch for the passage of the bolt 19′, which is screwed within the threaded bore of the studs 17 and 26. The notch 38 has an enlarged end 39 for accomodating and gaining access to the head of the bolt.

FIGS. 2 and 9 show a modification of the skate wherein the back shoe supporting frame 10′ is provided with means for spring loading the back of the roller bar 1 or the back of the ice-skate blade 36. The back supporting frame 10′ is similar to the frame 10, except that the rear leg 21′ forms a rear extension with a step 40 and that the ears 22′ are longer than the corresponding ears 22. The blade 36 is modified to replace its circular hole at the back by an elongated vertically extending slot 41 receiving the bolt 15 and nut 16, whereby the blade can move up and down with respect to said bolt and nut.

A compression coil spring 42 extends within bushing 43 secured in frame 10′ and opening at the top of the step 40. This bushing 43 is inwardly threaded to receive a bolt 44, which serves to adjust the compression of the spring 42. The spring 42 pushes on a plunger 45.

I claim:

1. A roller skate including three rollers to be rotatably mounted to the bottom of a shoe in alignment with the longitudinal axis of the shoe, characterized in that the rear and middle rollers are spaced apart a greater distance than the distance between the middle and front rollers, and are located on each side of the vertical line passing through the center of gravity of a person standing up on the skate, the ground contact zone of the front roller being at a higher level than that of the rear and middle rollers, an elongated roller carrying bar and a pair of separate shoe supporting frames securable to a shoe sole and each detachably secured to said bar, whereby bars of different lengths may be secured to the same shoe supporting frames to fit shoes of different sizes, each shoe supporting frame being detachably secured to said bar at two spaced zones, namely: at the front and back of each frame with the rear frame straddling the rear roller and the front frame straddling the middle and front rollers, and wherein the back of the rear frame and the front of the front frame have each a pair of spaced ears straddling the rear and front end portions of said bar respectively and nut and bolt means extending through registering holes in said ears and bar end portions to detachably secure said bar to said frames, and wherein the front of said rear frame and the back of said front frame have downwardly depending studs bearing on the top of said roller carrying bar.

2. A roller skate as claimed in claim 1, wherein said roller carrying bar is of U-shape cross-section with a top web and side flanges, bolt means extending through said web and screwed within said studs, the axes of said rollers being removably carried by said side flanges, said rollers extending upwardly from said side flanges through openings in said web.

3. A roller skate as claimed in claim 2, wherein the side flanges of said roller carrying bar are bent and brought together at the front and back ends of said bar, to be inserted between said pair of spaced ears.

4. A roller skate as claimed in claim 3, further including spring means at the back end of said back frame, resiliently engaging said blade.

5. A roller skate for use on a plastic surface comprising a roller carrying bar, shoe-supporting frame means secured to said bar and fixed to the heel and sole of a shoe to carry said bar in longitudinal alignment with a shoe underneath the latter, said bar including a pair of spaced-apart substantially parallel flanges, three rollers inserted between, and rotatably carried by, said flanges and arranged in a single row longitudinally of said shoe, the rear and middle rollers being spaced apart in the longitudinal direction of said bar, a greater distance than the distance between the middle and front rollers and being located rearwardly and forwardly respectively of the vertical line passing through the center of gravity of a person standing up on the skate, said flanges protruding forwardly and rearwardly of the front and rear rollers, respectively, and being joined together at their front and rear ends, each roller having a narrow metal rim with a peripheral surface which is straight in cross-section and defines sharp peripheral edges, the ground contact zone of the front roller being at a higher level than that of the rear and middle rollers.

* * * * *